United States Patent [19]

Lancelot, III et al.

[11] 4,197,783

[45] Apr. 15, 1980

[54] ALIGNER TIE

[75] Inventors: B. Harry Lancelot, III, Hurst; Robert M. MacRobbie, Keller, both of Tex.

[73] Assignee: Brown Company, Pasadena, Calif.

[21] Appl. No.: 902,507

[22] Filed: May 3, 1978

[51] Int. Cl.[2] ..... E04G 17/06

[52] U.S. Cl. ..... 85/9 W; 52/698; 228/173 C; 249/213; 254/67; 403/271

[58] Field of Search ..... 85/9 W; 52/378, 698, 52/699, 711, 713; 249/38, 40, 188, 207, 213, 219 W; 254/29 A, 67; 228/173 C; 403/271

[56] References Cited

U.S. PATENT DOCUMENTS

| | | | |
|---|---|---|---|
| 1,069,821 | 8/1913 | Sherwood | 249/213 |
| 1,179,326 | 4/1916 | Jones | 254/67 |
| 2,375,648 | 5/1945 | Hamilton | 249/40 X |
| 2,646,703 | 7/1953 | Erbe | 249/213 X |
| 2,985,937 | 5/1961 | Hillberg | 249/207 |
| 2,998,225 | 8/1961 | Huber | 254/67 |
| 3,273,848 | 9/1966 | Allen et al. | 249/213 UX |
| 3,286,419 | 11/1966 | Eriksson | 52/698 X |
| 3,633,867 | 1/1972 | Eriksson | 249/213 |

FOREIGN PATENT DOCUMENTS

| | | | |
|---|---|---|---|
| 589640 | 12/1959 | Canada | 403/271 |
| 2713462 | 10/1974 | Fed. Rep. of Germany | 254/67 |

*Primary Examiner*—Thomas J. Holko

*Attorney, Agent, or Firm*—Smyth, Pavitt, Siegemund, Jones & Martella

[57] ABSTRACT

A cold rolled lag stud has one end fastened to a wall or other support structure, while carrying a stud head capture head on its other end. The capture head has been bent from a rectangular blank and has a base, an upright front wall, a rearwardly and downwardly slanting top, and an end portion extending parallel to the base. Weld-assisting protrusions on the base and the end portion hold the lag stud and are welded thereto. The top of the head and the front wall have a slot for insertion of the head and shank end of the stud to be captured.

5 Claims, 5 Drawing Figures

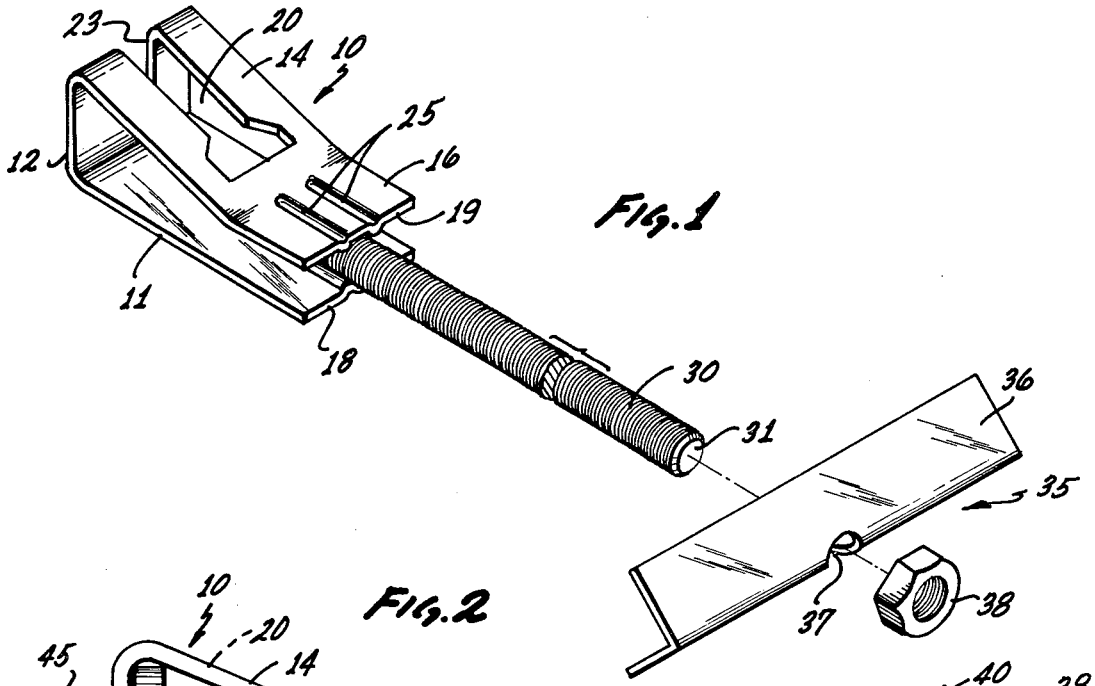
FIG. 1
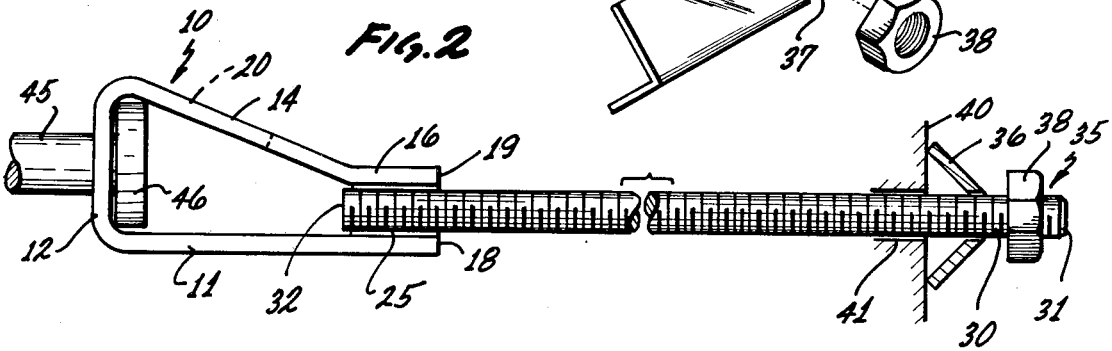
FIG. 2
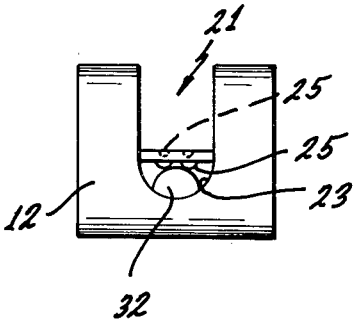
FIG. 3
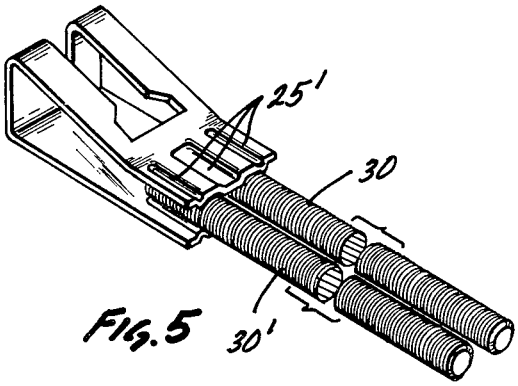
FIG. 5
FIG. 4
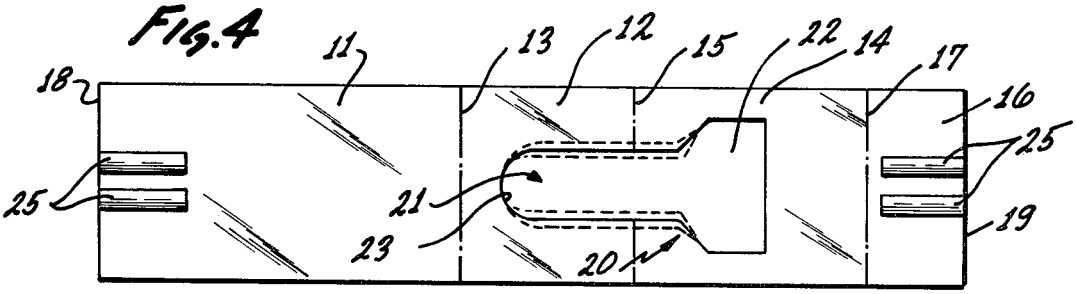

ALIGNER TIE

BACKGROUND AND SUMMARY OF THE INVENTION

The present invention relates to an aligner tie and anchor stabilizer, and more particularly, the invention relates to a structure which permits capture of an anchored bolt or a stud head, while fastening that bolt or head indirectly to a wall structure or the like, and stabilizing its position. A device of the type to which the invention refers can be used, for example, in concrete form work for stabilizing the position of sheet piling or sheet liners in relation to concrete re-inforcing bars before and, most importantly, during pouring of the concrete. The heads to be captured are welded or otherwise affixed to the liner or piling. Such an aligner tie must be strong because it must have some or even significant load bearing (tension) capabilities.

In accordance with the preferred embodiment of the invention, it is suggested to provide a bar or rod element, preferably a partially or completely threaded bolt or lag stud having one end fastened, e.g. bolted, to a wall stucture, a network of re-inforcing bars or the like, while carrying a stud head capturing device on the second or opposite end. The stud or bolt head to be captured is secured to the part to be stabilized, e.g. a sheet liner or the like. This capture device or capture head is made from a single piece blank which has been folded or bent into a particular configuration. The capture head is to have a flat base, a front wall extending upwardly from the base, a top which extends back and is preferably slanted down, i.e. the angle to the front wall is more than 90°, and an end portion extending from the top and parallell to the flat base. The end portion and the flat base are provided with integral ribs, facing each other in pairs for welding to the bar element (lag stud) at the above-mentioned second end thereof. The top and the front wall of the capture head have a single slot which receives the head and an end portion of the stud to be captured and held.

The entire aligner tie is very simple but very effective. Moreover, it can readily be made as it has only two major components, the stud and the single piece blank which has been bent into the capture head. The end of the stud not carrying the capture head will be fastened in an appropriate manner to a wall structure, particularly the rear thereof, thereby tensioning the captured head against the front wall of the capture head.

Accordingly, it is an object of the present invention to provide a new and improved aligner tie.

It is another object of the present invention to provide a new and improved device for capturing stud heads in particular positions and orientation to re-inforcing bars for concrete or other walls or support structures, and is preferably used as position stabilizer of parts in relation to each other for form work.

DESCRIPTION OF THE DRAWINGS

While the specification concludes with claims particularly poitning out and distinctly claiming the subject matter which is regarded as the invention, it is believed that the invention, the objects and features of the invention and further objects, features and advantages thereof will be better understood from the following description taken in connection with the accompanying drawings in which:

FIG. 1 is a perspective view, partially an exploded view of an aligner tie in accordance with the preferred embodiment;

FIG. 2 is a side view of the same aligner tie as fastened to a wall;

FIG. 3 is a front view of the aligner tie.

FIG. 4 is a plane view of a blank of which the capture head of the aligner tie will be made; and FIG. 5 is a perspective view of a modified aligner tie.

Proceeding now to the detailed description of the drawings, the figures illustrate an anchor stabilizer and aligner tie, which is comprised of two major components: a capture head 10 and a continuously threaded lag stud 30. The rear end 31 of the lag stud 30 is shown in FIG. 1 in relation to a particular set of fastening devices 35; the front end 32 of the lag stud is inserted in the capture head 10.

The fastening devices 35 are, in this instant, comprised of a V-shaped or angle element 36, and a lag nut 38. The angle element 36 has a bore 37, which is located in the bottom of the V-groove as well as in central location with respect to the lateral extension of the element 36. The nut 38 is threaded onto that one end 31 of stud 30; the stud traverses a bore 41 of a wall structure, and nut 38 clamps element 36 against the rear surface of the wall 40 or the like which may pertain to a form.

The fastening devices 35 are shown here by way of example only, though, a threaded nut type fastener is preferred. However, the angle piece 36 is used in some instances only, such as a concrete rear wall, or as a support bearing against re-inforcing bars of a concrete wall. Alternatively, one may use disk-shaped washers with or without additional spacers for fastening and positioning the lag stud on a wall structure.

As far as the element 30 is concerned, a threaded configuration is preferred, as one may provide such lag studs rather easily and simply in long configurations from which suitable lengths are cut. Thus, one will not require that any particular end threading for the fastener devices 35 be cut subsequently. However, such a threaded configuration is not essential in principle, one may use partially threaded rods or even just bars or rods without any threads. On the other hand, it should be added that the threaded configuration is of further advantage for purposes of fastening this element to the capture head. Threading may have been provided by helically cold rolling a bar.

The capture head 10 is a single piece and has been made from a rather simple, basically rectangular blank. This blank has been bent or flanged along several fold lines 13, 15 and 17. Accordingly, the capture head has a base 11, a front wall 12 which extends at right angles and up from base 11. FIG. 4 shows line 13 for a fold along which wall 12 has been bent up from base 11. A top portion 14 of head 10 is angled off by more than 90°, and has, therefore, a slanted down configuration. The last or end portion 16 extends parallel to base 11, i.e. has been bent slightly along line 17 by an angle equal to an angle by which the angle between parts 12 and 14 exceeds 90°. The short sides 18, 19 of the rectangular blank are vertically aligned in the completed configuration of the head.

The capture head 10 is provided with a slot 20 having a long and narrower portion 21 and a side, head-like portion 22. The narrow portion is traversed by the fold line 15 and, thus, extends into front wall 12. The dashed lines in FIG. 4 indicate that one may wish to make the slot differently wide. The rounded end 23 of the small or narrow slot portion serves as a cradle for the shank of a stud whose head is to be captured by the device. As can be seen best from FIG. 2, a stud or bolt 45 with a head 46 may be received in the slot and held by the capture head 10. By way of example, bolt 45 may extend from a sheet piling to be held by the tie in relation to a wall, e.g., form side 40. Ultimately, the space between the sheet piling and the form will be filled with concrete. The wide portion 22 of the slot in the captan head receives the head 46 upon insertion, but in the installed position that head abuts the front wall 12 and is, in fact, held there against.

The base 11 as well as the end portion 16 are provided with ribs 25 which have been made by stamping or embossing from the respective opposite sides. These ribs extend towards and face each other in pairs across the space between parts 11 and 16. Particularly,the two ribs on base 11 serve as cradle and position the stud 30 adjacent the end 32 thereof, and the two ribs on part 16 hold the stud from the opposite side. Thus, these ribs or protrusions 25 position the bolt or stud 30, and are provided to obtain adequate and stable support for the stud and from opposite sides for purposes of welding the stud 30 to these ribs to thereby affix the stud to the head 10. The threading of the stud 30 was found to be of additional advantage here, to obtain a good bond by means of the welding, as the contact area with the fillet is enlarged.

It can, thus be seen that head 10 is held on and secured to the stud 30 and thereby supports the shank of stud 45, and holds and captures the head 46 thereof. If the stud 30 traverses the bore 41 in wall 40 loosely, or is fastened or embedded in the wall at a later time, threading of the nut fastener 38 onto the lag stud 30 tensions the capture head 10, and here particularly its front wall 12 against head 46.

FIG. 5 shows optionally how a single capture head can be used for fastening to two lag studs 30 and 30'. One will use here three ribs 25' ont the base and three ribs 25' on the end part, and each of the studs is positioned on and between respective two ribs on each side.

Conceivably, the top portion 14 of the capture head could also be constructed to extend parallel to the base 11, so that a short vertical transition were required between such a top and end portion 16. This configuration, however, requires another bend and is, therefore, not preferred. The invention is not limited to the embodiments described above but all changes and modifications thereof not constituting departures from the spirit and scope of the invention are intended to be included.

We claim:

1. An aligner tie, comprising:

a bar element having a first and a second end;

a capture head made from a single piece blank and having (a) a flat base, (b) a front wall extending up from the base, (c) a top portion extending back from the front wall, and (d) a end portion adjacent to but spaced from the flat base;

at least two ribs on each of the flat base and the end portion, the ribs of the flat base facing the ribs of the end portion, the bar element being welded to the ribs near the first end; and means defining a slot in the rear wall and the top to receive a stud and its head to be captured.

2. An aligner tie as in claim 1, including fastener means on and adjacent to the second end of the bar.

3. An aligner tie as in claim 1 or 2, said bar element being at least partially threaded.

4. An aligner tie as in claim 1, said ribs being embossed protrusions.

5. An aligner tie as in claim 1, wherein the top portion is downwardly slanted and the end portion extends parallelly to the base.

* * * * *